US005791327A

United States Patent [19]

Riggs et al.

[11] Patent Number: 5,791,327

[45] Date of Patent: Aug. 11, 1998

[54] PERSONAL PROTECTION DEVICE HAVING A NON-LETHAL PROJECTILE

[75] Inventors: Donald E. Riggs, deceased, late of Carson City, Nev., by Patricia Riggs, executrix; Bernard K. Hymmen, Snohomish, Wash.; Karl H. Hymmen, Sparks, Nev.

[73] Assignee: Code-Eagle, Inc., Carson City, Nev.

[21] Appl. No.: 526,538

[22] Filed: Jan. 18, 1997

[51] Int. Cl.[6] ..... F41B 11/00; F41B 11/06

[52] U.S. Cl. ..... 124/71; 124/56; 124/57

[58] Field of Search ..... 124/37, 40, 56, 124/57, 61, 66, 67, 71; 102/502, 513

[56] References Cited

U.S. PATENT DOCUMENTS

| | | | |
|---|---|---|---|
| 2,918,286 | 12/1959 | Foulger | 124/56 |
| 3,649,020 | 3/1972 | Hall | 102/513 |
| 3,830,214 | 8/1974 | Curtis | 124/57 |
| 4,892,038 | 1/1990 | Lubbers | 102/513 X |
| 5,018,450 | 5/1991 | Smith | 102/513 |
| 5,078,117 | 1/1992 | Cover | 124/56 X |
| 5,254,379 | 10/1993 | Kotsiopoulos et al. | 102/513 X |
| 5,448,951 | 9/1995 | Olson | 102/513 |

FOREIGN PATENT DOCUMENTS

| | | | |
|---|---|---|---|
| 2278909 | 10/1994 | United Kingdom | 124/57 |

*Primary Examiner*—John A. Ricci
*Attorney, Agent, or Firm*—Robert Charles Hill

[57] ABSTRACT

A combination cartridge [21] and grip [20] for propelling a projectile [28] having frangible walls [89] forming a cavity [93] for holding a disabling agent such that when the projectile strikes an object it will burst and spread the agent over the target, and wherein the cartridge includes a chamber [27A] for receiving a projectile and the grip includes a firing assemblies [46A], moveable between cocked and uncocked positions, and a trigger actuator [37A] for allowing the associated firing assembly to move from the cocked to the uncocked position, with means for latching the cartridge to the grip including cocking means for cocking the firing assembly when the cartridge and grip are latched together, and means for propelling the projectile from the cartridge towards the object in response to the firing assembly being activated by the trigger.

11 Claims, 7 Drawing Sheets

PERSONAL PROTECTION DEVICE HAVING A NON-LETHAL PROJECTILE

BACKGROUND OF THE INVENTION

1. Field of the Invention

This invention relates to a hand held device for propelling a projectile which, when hitting an individual, will render them temporarily incapacitated without permanent injury.

2. Description of the Prior Art

In police related activities it is sometimes necessary to disable violent or uncontrollable people so they can be restrained. Also in our private lives it can become necessary to protect against those threatening bodily harm. At the present time the most prominent ways to render a person temporarily helpless, without personal contact, are by spraying them with an agent by use of a spray can, or shooting them with a pair of dart like projectiles which discharge an electrical pulse into the body. Both of these methods can do away with the need for direct physical contact with the target, but each have their shortcomings.

Using the spray can requires that the user be close to the person, a situation to be avoided if at all possible. Obviously, factors such as wind and distance lowers the effectiveness of this method of protection. While the electrical shock device can be effective when the target is somewhat further away, the ultimate physical consequence of the electrical shock cannot always be anticipated thereby making the use of this method somewhat unpredictable. Also heavy clothing may prevent the projectiles from contacting a person's body.

The general intent of the subject invention is to provide a personal defense device that overcomes the above outlined shortcomings and can be used by both law enforcement officials and private individuals with equal effectiveness.

SUMMARY OF THE INVENTION

A combination cartridge and grip for propelling a projectile carrying an agent, such as pepper powder, or a gas or liquid, capable of temporarily disabling a person, wherein the cartridge includes a rigid housing forming one or more chambers and wherein each chamber holds a single projectile with an associated primer cap capable of propelling the projectile from the chamber, and the grip includes a housing formed to be grasped in the users hand and enclosing a firing pin assembly which is automatically cocked when the cartridge is attached to the grip, and a trigger mechanism for releasing the firing pin to strike and discharge the primer cap for propelling the projectile from the cartridge and towards a target. Each projectile includes sidewalls closed at one end by an aerodynamically shaped point and closed at the other end by a base member thereby forming a chamber for holding a disabling agent, with the sidewalls having formed therein fracture lines preferably extending both longitudinally and laterally to enhance the breaking of the walls on impact for causing lateral distribution of the agent from the projectile. A safety cap is provided which fits over the cartridge and locks onto the grip to disable the trigger and prevent accidental firing of the projectile.

DESCRIPTIONS OF THE DRAWINGS

DESCRIPTION OF A PREFERRED EMBODIMENT OF THE INVENTION

Figure 1:
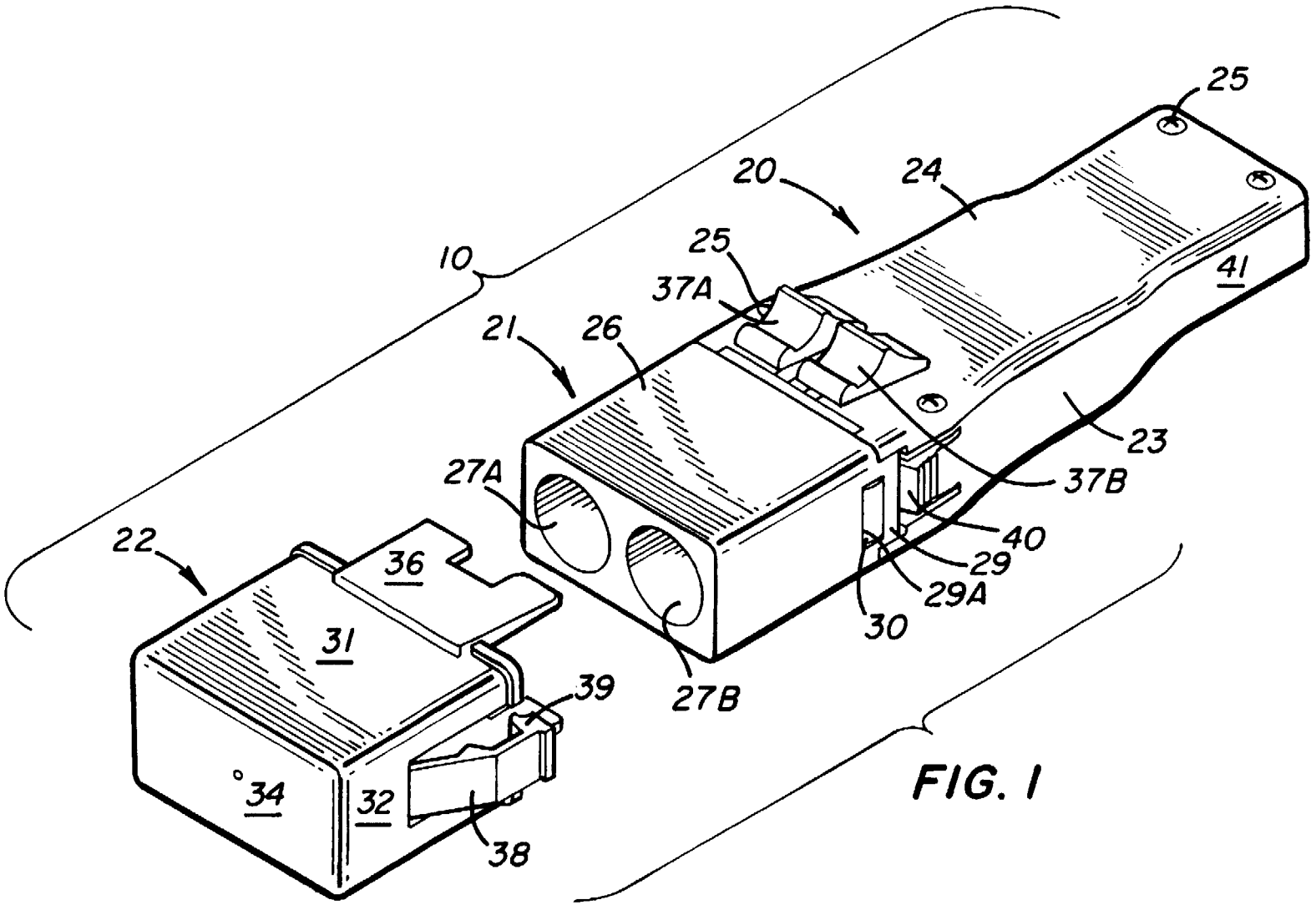
FIG. 1 is a perspective view of the grip and attached cartridge with the safety cap in position to be inserted onto the grip and over the cartridge.

In FIG. 1 is shown a preferred embodiment 10 of the invention comprising a grip 20 with an attached cartridge 21 and a safety cover 22 aligned for attachment to the grip. The grip includes a first housing 23 contoured to fit the hand and having a cover plate 24 normally held on by screws 25. The cartridge 21 comprises a second housing 26 having two cylindrical openings or chambers 27A and 27B into which are inserted projectiles 28 (FIG. 5). The cartridge 21 fits over the end of the grip 20 sufficiently for the end flaps 29 having openings 29A to overlap and align with the spring latches 30 for locking the cartridge 21 in place with the end wall 33 (FIG. 4) abutting the adjacent wall 66 of the grip 20 and holes 65 in the grip end wall 66 aligning with the holes 33A (FIG. 5) in the adjacent cartridge end wall 66. The cartridge holes are each sized to receive and hold a primer cap 33B which, when detonated, serves as means to propel the associated projectile out of the cartridge by expelling pressured gas through an orifice 33C.

While in the embodiment shown in the drawings the cartridge 21 and grip 20 are separable to permit replacement of a cartridge having unfired projectiles, the cartridge can also be made as an integral part of the grip. In this embodiment the grip either would be disposed of after the projectile or projectiles are fired, or new projectiles could be loaded directly into the grip.

Figure 3:
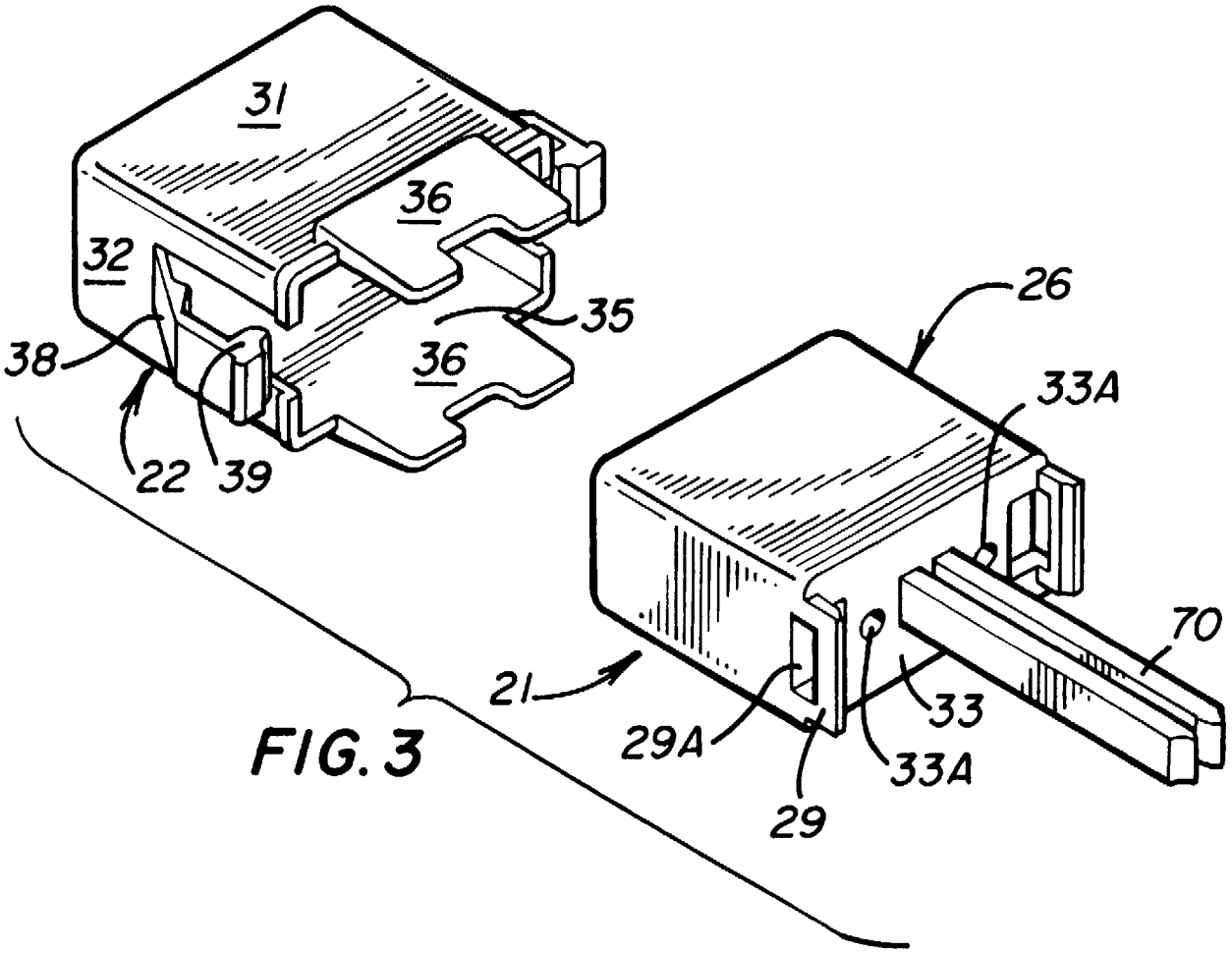
FIG. 3 is a perspective view of a cartridge and safety cap.

The safety cap 22 includes opposing pairs of sidewalls 31 and 32 and an endwall 34 together forming a cavity 35 (FIG. 3) sized to fit over the cartridge 21 with a friction fit. When the safety cap 22 is fitted onto the cartridge attached to the grip 20, an extension 36 slides under and along a pair of trigger actuators 37A and 37B extending from the grip, thereby serving as means to prevent the trigger actuators from being actuated. Thus the safety cap acts as a safety for the grip by preventing the firing of either of the projectiles 28 in a manner explained in greater detail later.

A secondary purpose for the safety cap involves the removal of the cartridge from the grip. As shown primarily in FIG. 1, the cartridge is fixed to the grip by the spring latches 30 on opposite sides of the grip being spring loaded into the aligned openings 29A in the end flaps 29 on the cartridge 21. For removal of the cartridge from the grip, both spring latches must be depressed sufficiently to clear the associated end flap. For this purpose each of the sidewalls 32 of the safety cap includes a latch 38 including an inwardly facing projection 39 that aligns with the adjacent spring latch 30 of the grip. By placing the safety cap over the cartridge and squeezing the opposing latches 38, the projections 39 depress the spring latches 30 sufficiently to clear the end flaps 29 and release the cartridge from the grip while it is enclosed in the safety cap. To remove the safety cap while leaving the cartridge on the grip, the safety cap is grasped in any manner so as not to depress the latches 38 while pulling it off.

Figure 4:
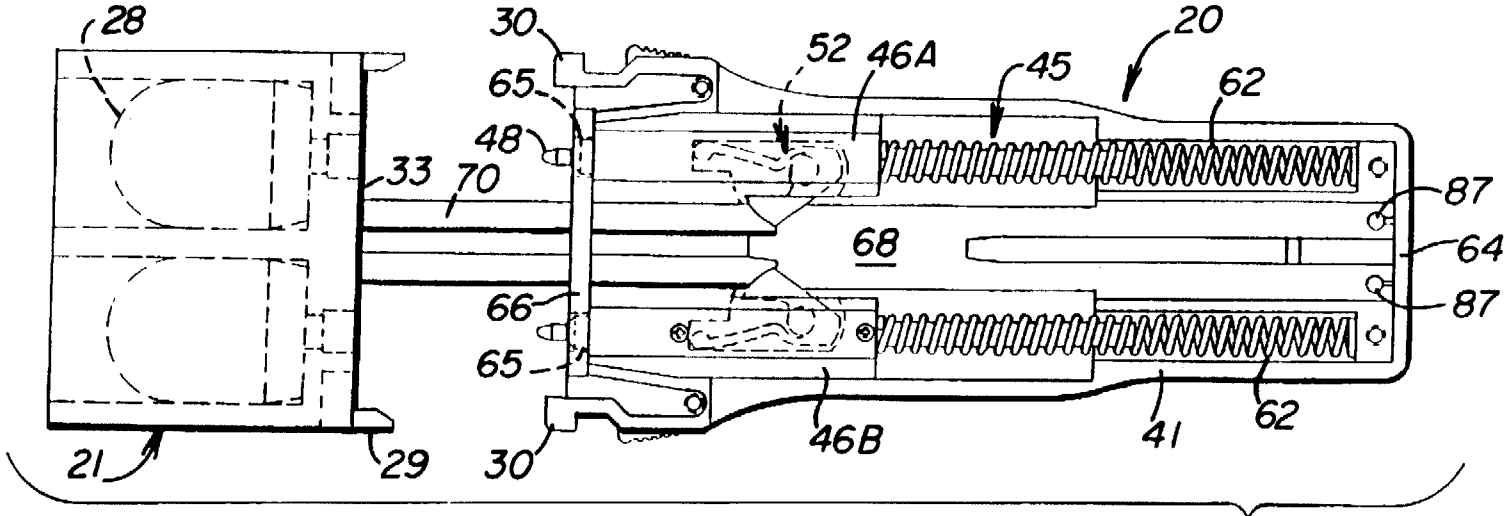
FIG. 4 is a top view of the grip with the cover plate and trigger assembly removed and the cartridge being used to initiate cocking of the trigger assembly.
Figure 5:
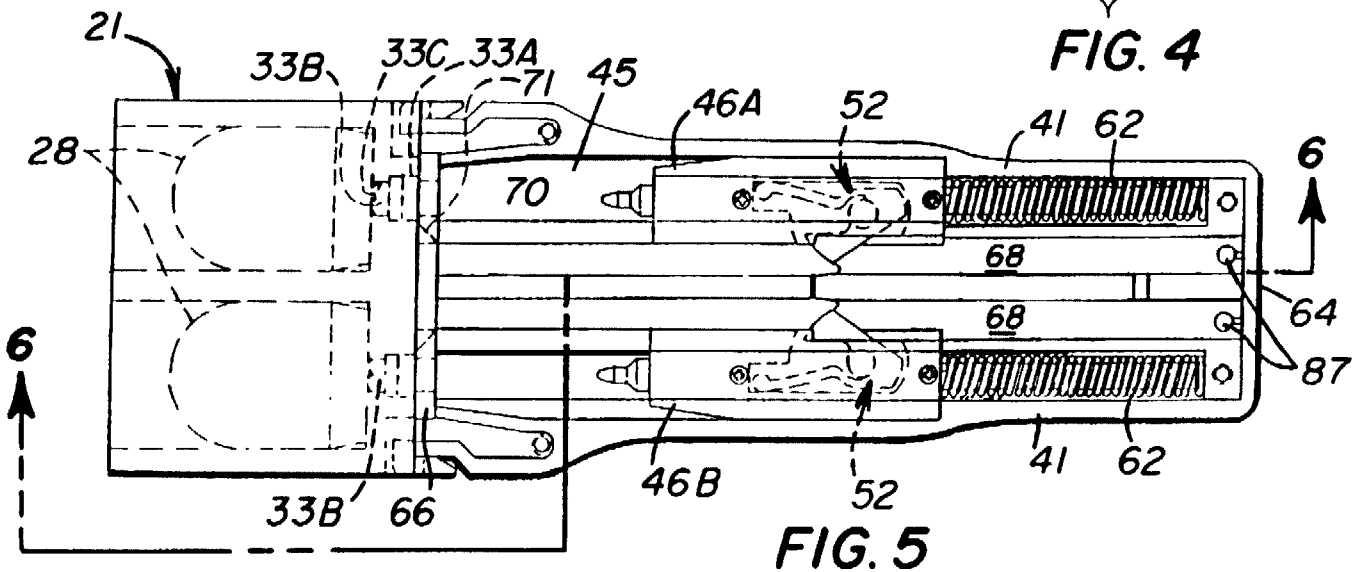
FIG. 5 is a view like FIG. 4 with the cartridge inserted and the firing pin assembly cocked.

In this embodiment, the internal cavity 45 (FIGS. 4 and 5) of the grip 20 is formed to hold a pair of firing assemblies 46 identified separately as firing assemblies 46A and 46B to allow movement of each assembly from the second or uncocked position shown in FIG. 4 to the first or cocked position shown in FIG. 5. The firing assembly 46B includes a firing pin 48 fixed in a groove 49 (FIG. 2) of a firing pin support member 50. This member also has formed therein a second cavity 51 for holding a pawl 52 or cocking means in a position with a spring end 54 bearing against the pin support member 50 while a cam end 55 thereof extends through an opening 56 in the sidewall of the pin support member. Both the firing pin and the pawl are clamped in the support member by a cover 57 held by screws 59.

Extending from the end of each firing pin support member 50 opposite the firing pin 48 is a shaft 61 around which is mounted a tubular compression spring 62. This compression spring bears against the end wall 64 of the grip 20 to bias the associated firing pin 48 towards the uncocked position, as shown in FIG. 4, with the firing pin 48 extending through a hole 65 in the end wall 66 of the grip and into an aligning hole 33A in the cartridge 21 to strike and detonate a primer cap 33B.

The firing pin assembly 46A is a mirror image of the firing pin assembly 46B just described. These two firing pin assemblies fit side by side in the parallel grooves 72 formed in the bottom wall 68 of the grip cavity 67 formed by the side walls 41, end walls 64 and 66, and this bottom wall 68. These wall members are preferably all molded together in one piece and a cover plate 24 held on by screws 25 closes the remaining side of the cavity 67. As means for moving the firing pin assemblies from the uncocked or second position as shown in FIG. 4, to the cocked or first position shown in FIG. 5, there is attached to the cartridge 21 a cocking arm or projection 70 which, as the cartridge 21 is mounted on the grip 20, enters an opening 71 in the end wall 66 and extends along the cavity 45 of the grip 20 centered between the firing pin assemblies 46A and 46B therein. The forward end of the cocking arm thus contacts the opposing cam ends 55 of the pawls 52 and initiates movement from left to right, in the FIGS. 4 and 5, until the firing pin assemblies reach the cocked position shown in FIG. 5. During this movement the compression springs 62 are compressed between the firing pin support members 50 and the end wall 64 of the grip. When the cartridge 21 becomes interlocked with the grip 20 by the end flaps 29 overlapping the spring latches 30 and the spring latches locking into the openings 29A, the firing pin assemblies are in the cocked position, held there by the cocking arm 70 pressing against the cam ends 55 serving as releasible locking means, while remaining biased towards the uncocked position by the compressed springs 62.

Figure 2:
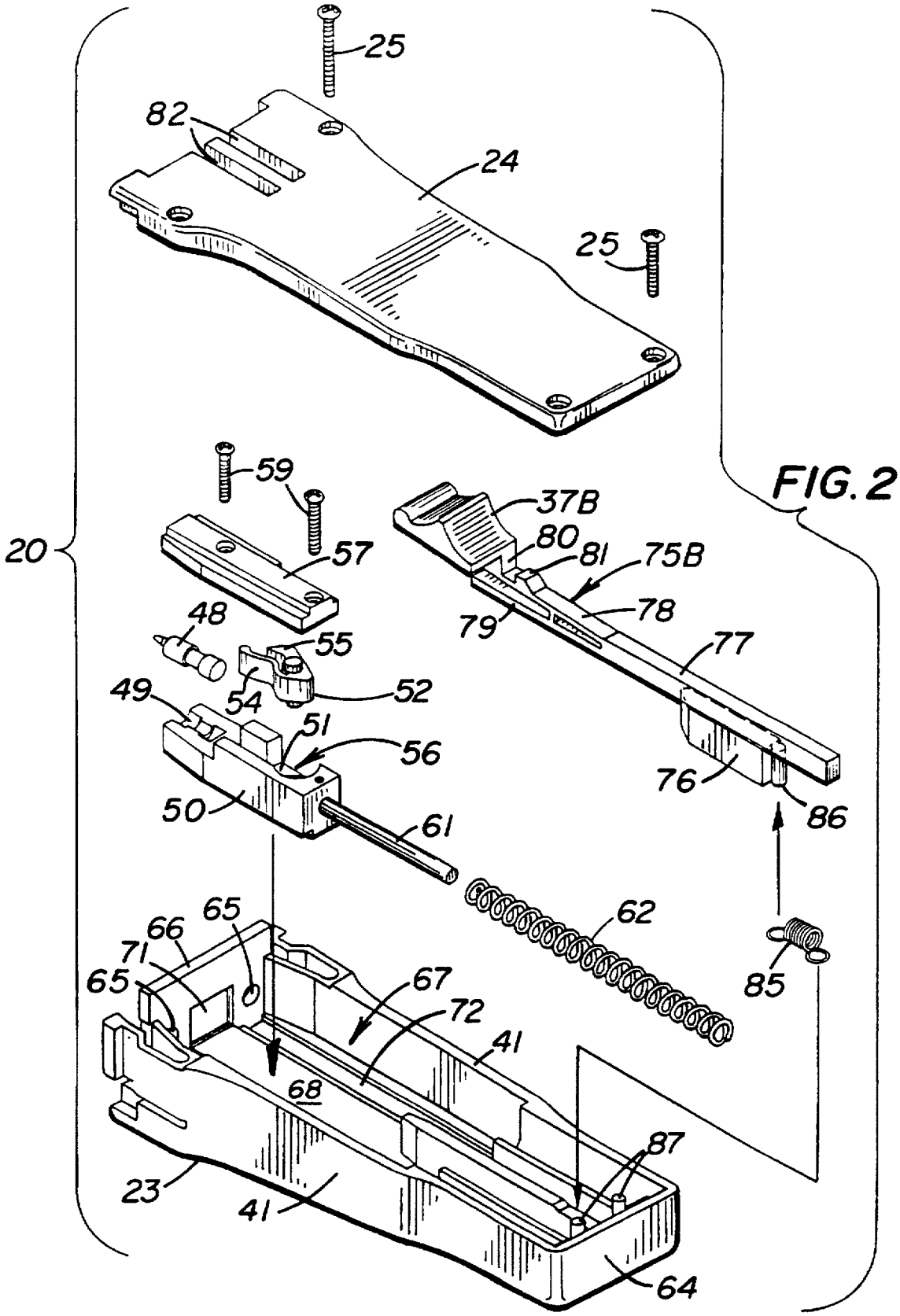
FIG. 2 is an exploded view of the grip and one firing pin and trigger assembly.
Figure 6:
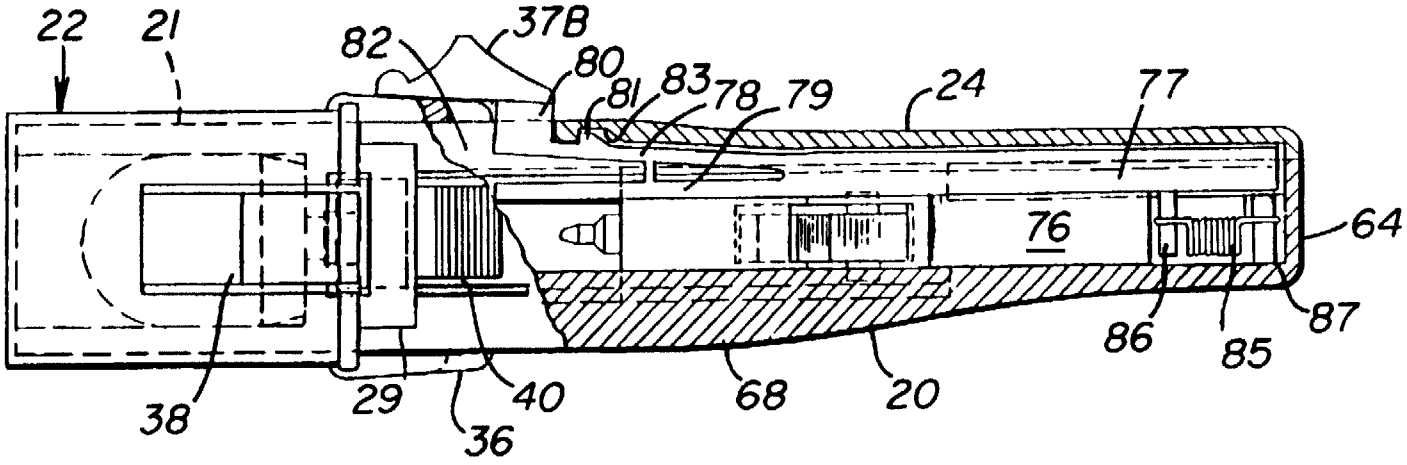
FIG. 6 is a partial cross sectional view along the line 6—6 of FIG. 5 showing the trigger assembly latched to the cover plate to hold the firing pin assembly in the cocked position.
Figure 7:
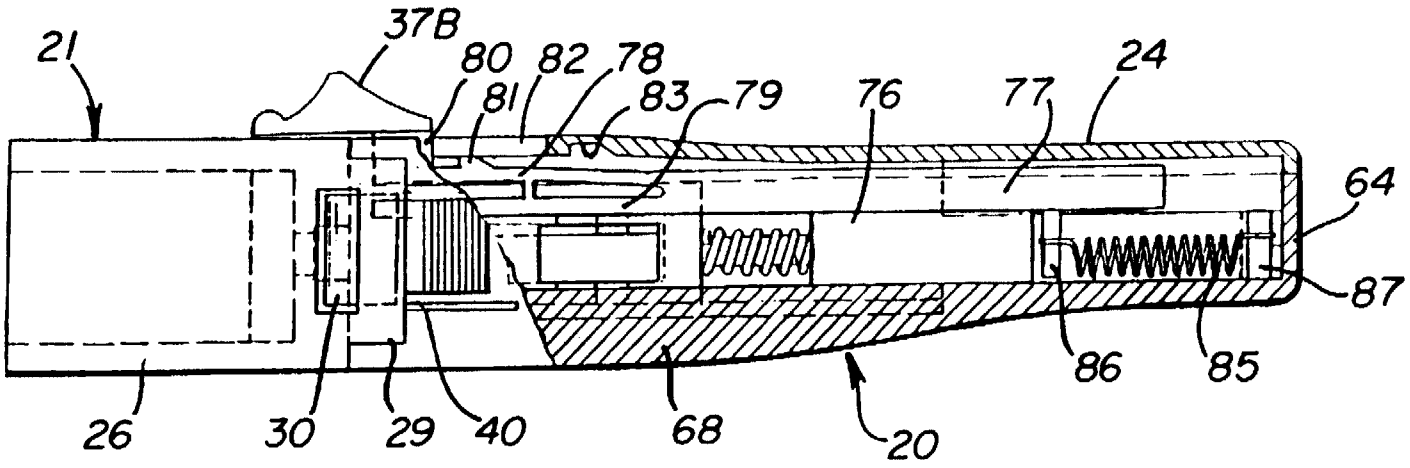
FIG. 7 shows the trigger assembly pushed forward to the position for releasing the firing pin.

To selectively release the firing pin assemblies 46A and 46B, triggers 37A and 37B are positioned, each with an associated trigger release cam 76, within the grip cavity 45 for movement in line with an associated pawl 52. Each release cam is fixed to a strut 77 extending parallel to and beneath the cover plate 24 (FIGS. 2 and 6). The extended end of each strut is split into two arms 78 and 79 with the upper arm 78 being terminated by a trigger support 80 extending laterally through an aligned slot 82 in the cover plate 24 for supporting the trigger 37B. Each trigger is biased towards the end wall 64 of the grip 20 by a tension spring 85 supported between a post 86 fixed to the strut 77 adjacent the trigger release cam 76, and a second post 87 fixed to a raised portion of the bottom wall 68 of the grip. As shown in FIG. 6, each trigger is locked against accidental forward movement that brings the release cam into contact with the associated cam end 55 by a projection 81 that is spring biased by the spring arm 78 into a groove 83 in the underside of the cover plate 24.

In order for the trigger to be actuated to cause the release cam 76 to release the adjacent cam end 55 and allow the trigger to move under the force of the compression spring 62 to a second position and detonate the associated primer cap 33B, the trigger must first be depressed and thereafter moved forward. Forward movement of the trigger brings the angular tip of the release cam 76 into contact with the adjacent cam end 55, serving to rotate the pawl 52 and allowing the cam end to move past the end of the cocking arm 70 thereby permitting the firing pin to be driven into contact with the primer cap 33B. The safety cover 22 prevents firing of a projectile since the extension 36 is positioned between the bottoms of the trigger actuators and the cover plate 24 thereby serving as means preventing disengagement of the projection 81 from the groove 83 and subsequent depression of the trigger actuators until the safety cover is removed.

Figure 8:
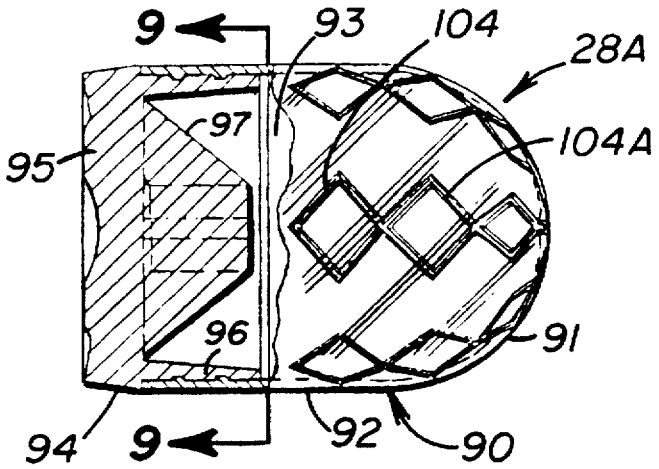
FIG. 8 is a partial sectional view of a projectile suitable for use with the cartridge shown in FIG. 3.
Figure 9:
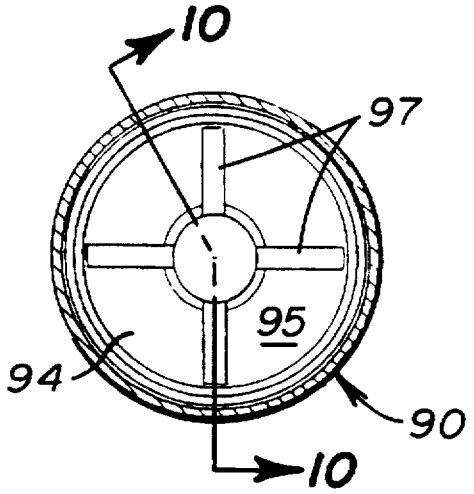
FIG. 9 is a view along line 9—9 of FIG. 8.
Figure 10:
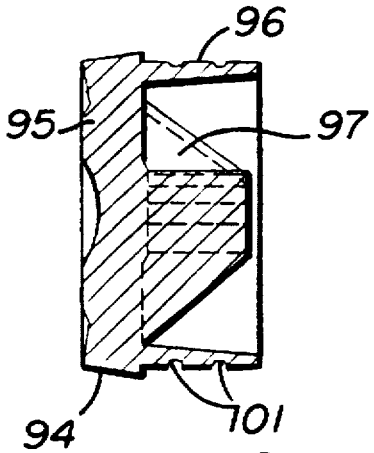
FIG. 10 is a sectional view of the projectile base member taken along the line 10—10 in FIG. 8.

While the projectile 28 (FIG. 5) may be of any type, in this embodiment of the invention it is designed to deliver a fluid or powder to a remote target or object and, upon impact, to rupture and spread the substance onto or in the vicinity of a target. For instance, such projectiles are used to deliver a disabling agent such as a pepper powder in the vicinity of an assailant. Also the agent may be a marking powder or liquid to indicate where the projectile hit. For this purpose the projectile 28A shown in FIG. 8 comprises walls 89 forming a hollow tip 90 aerodynamically shaped with a rounded end 91 and a cylindrical body 92 forming an inner cavity 93 closed at the end opposite the point by a base member 94. The base member 94 comprises an end wall 95 with a cylindrical sleeve 96 attached and having an outer diameter to form a friction fit with the inner surface of the cylindrical body 92. To reinforce the base member there are formed a plurality of ribs 97 extending radially outward from the center of the end wall to the sleeve. The main purpose of the base member 94 is to close the open end of the hollow tip 90, thereby closing the cavity 93 after the agent or other substance 98 is inserted, and to withstand the force of the pressured gas resulting from detonation of the primer cap 33B in the chamber 27. To further seal between the outer wall surface of the sleeve 96 and the inner surface of the overlapping portion of the cylindrical body 92 and to lock the tip and base member together, there is formed on the abutting surfaces pairs of interfitting rings 100 (FIG. 12) and grooves 101 (FIG. 10).

Figure 11:
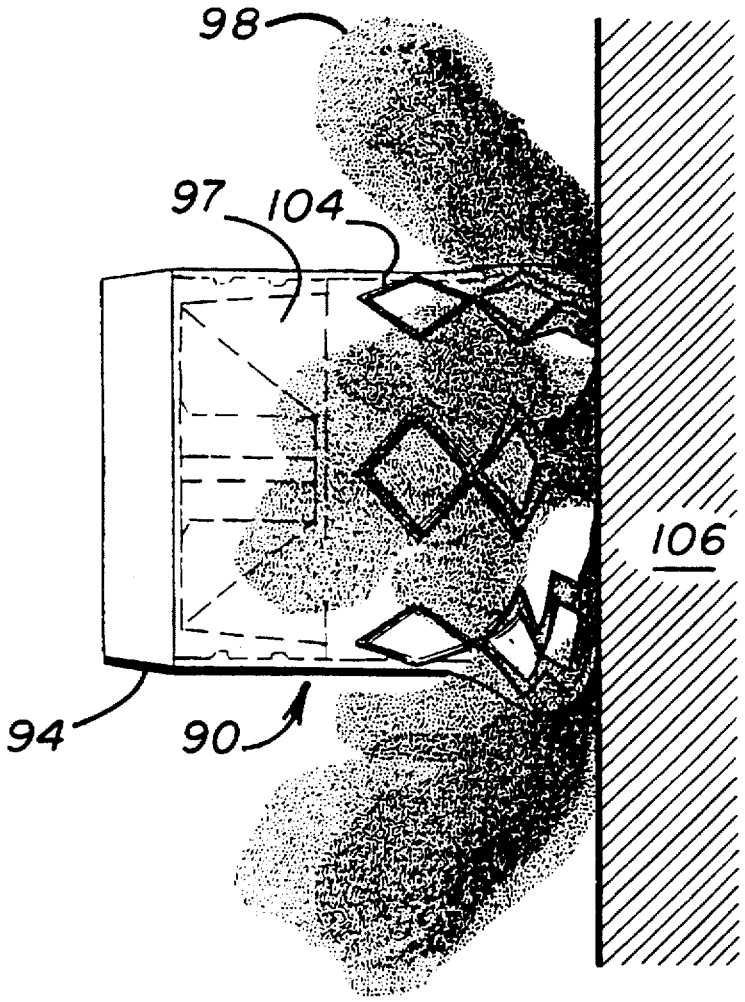
FIG. 11 shows the projectile of FIG. 8 hitting a target.

To facilitate fracturing of the projectile wall on impact with a target, the cylindrical body 92 is made of a frangible material and preferably include fracture lines or grooves 104 formed at least in the surface of the hollow tip 90. Preferably these fracture lines have portions 104A extending both laterally and longitudinally so as to cause separation of the walls of the tip in response to the compressive forces exerted longitudinally as the tip 91 strikes a target 106 (FIG. 11), and to react to the tensile forces resulting as the tip starts to split due to impact. The overall effect is to facilitate the breaking open of the projectile walls to enable the outflow of the contained agent 98 in the cavity 93. The tip is made of a pliant material such as plastic which collapses when striking a target 106, to thereby increase the pressure in the cavity 93. The force of the impact and the increased pressure in the tip cavity 93 causes the side wall to separate. As the tip side wall parts, the contained fluid or powder is forced out of the tip thereby forming a cloud of the substance surrounding the impact point.

To use the invention, a primer cap 33B is inserted in the hole 33A of the end wall 33 of the cartridge and a projectile 28 is placed into the opening 27. The safety cover is then fitted over the cartridge. The cartridge 21 then is fitted onto the grip 20 which acts to simultaneously cock the triggers or firing assemblies 46A and 46B. To fire a projectile, the safety cover is removed and one of the trigger actuators 37A or 37B is depressed and pushed forward while pointing the cartridge end with the openings 27 towards the intended target 106. Thereafter a second projectile can be fired by depressing the other trigger while aiming at a target.

Figure 12:
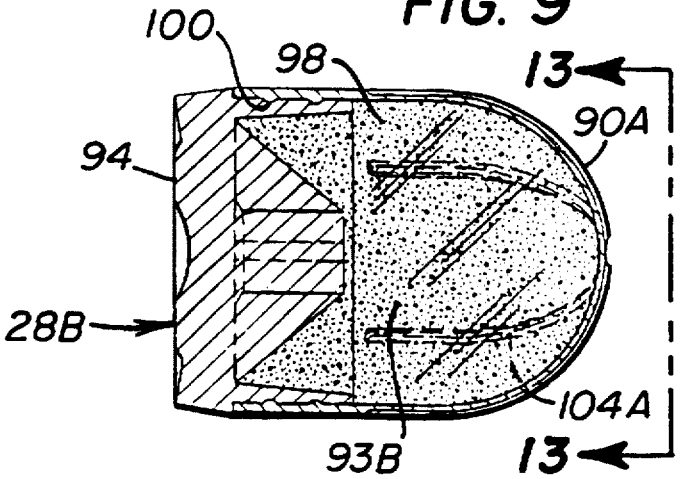
FIG. 12 is a section view of a second embodiment of the projectile.
Figure 13:
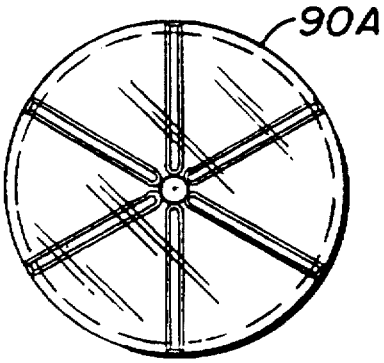
FIG. 13 is a view along the line 13—13 in FIG. 12.

In FIG. 12 is shown a second embodiment of the projectile 28B including a hollow tip 90A forming an internal cavity 93B with one end closed by a base member 94 after the addition of an agent 98 such as pepper powder. In this embodiment the tip walls have the fracture lines or grooves 104A extending along the side walls in planes passing through the center axis of the projectile.

Figure 14:
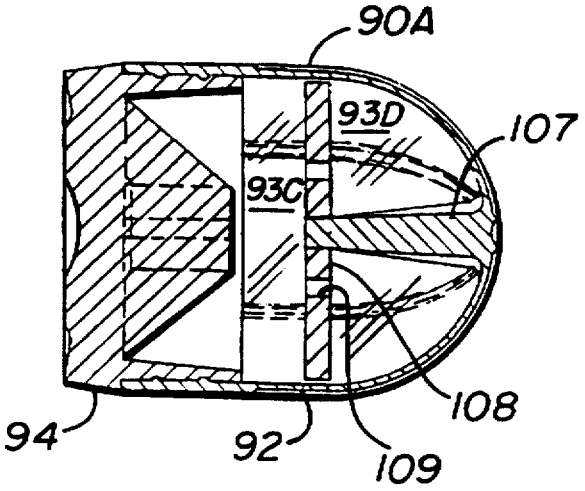
FIG. 14 is a sectional view of a third embodiment of the projectile.

To further facilitate the outward lateral flow of the fluid agent from the projectile cavity 93B on impact of the projectile with an object, a third embodiment of the projectile 28B is shown in FIG. 14. In this embodiment a diffuser 107 is fixed to the inside of the hollow tip 90A in a position to extend along the axis of the projectile towards the base member 94. This diffuser is conical shaped so as to deflect the agent in the cavity 93D laterally as it is thrust forward on impact of the projectile with an object 106 and thus enhance the lateral flow of the agent from the cavity when the tip walls are breached.

One possible problem that occurs with such hollow projectiles results from the projectile cavity not being completely filled with agent or the agent being compressible thereby leaving an air pocket which allows the fluid to shift toward the rear of the projectile during the rapid acceleration of firing. Such action of the fluid can make the projectile tip substantially lighter than the base which can render the projectile unstable in flight resulting in either an erratic or tumbling flight path. In the third embodiment shown in FIG. 14, a wall member 108 is supported on the extending end of the diffuser 107. The outer edges of this wall member 108 are in contact with the inner surface of the tip side wall 92. This wall member also has formed therein a plurality of holes 109 sized to allow a gradual flow of agent from the rear cavity 93C to the front cavity 93D. To prevent a rapid fluid shift within the projectile, the wall member 108 is positioned to serve as means to substantially limit any rapid shifting or flowing of agent from the forward cavity 93D to the rearward cavity 93C for a sufficiently long time to allow the projectile to reach the intended target, and thus help maintain the desired weight distribution of the projectile. During filling of the cavity 93C, the fluid flows gradually through openings 109 of the wall member to fill the cavity 93D.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A combination cartridge, projectile and grip for propelling the projectile towards an object, said cartridge comprising:

a first housing forming at least one first cavity for holding a single projectile with the cavity connecting with an opening in said housing through which the projectile can be propelled, a projection extending from said housing, and means for detachably latching said cartridge to said grip, said projectile sized to fit into said first cavity, said projectile including external walls forming an internal cavity to hold an agent, said external walls being made of a frangible material so as to break open when the projectile hits an object;

a primer cap positioned to propel said projectile from said first cavity when detonated;

said grip comprising:

a second housing forming a second cavity, a firing pin assembly held in said second cavity and including a firing pin positioned to move from a second position to contact and detonate said primer cap and a first position spaced from said primer cap, spring means biasing said firing pin towards said second position, releasible locking means for holding said firing pin in said first position, cocking means moveable by contact with said first housing projection as said cartridge is fastened to said grip to shift said firing pin assembly from the second position to the first position, and a trigger assembly having a trigger extending outside said first housing and moveable to release said releasable locking means to allow said firing pin to move to said second position and detonate said primer cap to cause said projectile to be propelled from said first housing.

2. A combination as defined in claim 1 wherein said primer cap is fixed to said first housing.

3. A combination as defined in claim 1 wherein said projectile walls include fracture lines to facilitate the breaking thereof.

4. A combination as defined in claim 1 including a safety cap sized to fit over at least a portion of said cartridge to prevent the accidental firing of said projectile.

5. A combination as defined in claim 4 wherein said safety cap includes means to prevent movement of said trigger.

6. A combination cartridge, projectile and grip for propelling the projectile towards an object, said cartridge comprising:

a first housing including a cavity for holding said projectile and having an opening through which the projectile can be propelled, and means for fastening said cartridge to said grip;

said projectile including external walls forming an internal cavity to hold an agent and being made to open when the projectile hits an object to allow the spreading of said agent around the object;

said grip comprising:

means for a propelling said projectile from said cartridge when activated, a firing assembly moveable between cocked and uncocked positions and when moved from the cocked to the uncocked position will cause the activation of said propelling means thereby causing said projectile to be propelled from said cartridge, means for cocking said firing assembly when said cartridge is fastened to said grip, and trigger means actuable to cause said firing assembly to move from the cocked to the uncocked position.

7. A combination as defined in claim 6 wherein said cartridge includes means for moving the firing assembly from the uncocked to the cocked position when the cartridge is attached to the grip.

8. A combination as defined in claim 6 including a safety cap sized to fit over said cartridge and including means to prevent said trigger means from being actuated.

9. A combination as defined in claim 6 including means to prevent the rapid shifting of said agent in said projectile while the projectile is being propelled.

10. A combination projectile and grip for propelling the projectile towards an object, said grip comprising a first housing including a cavity sized for holding the projectile and having an opening through which the projectile can be propelled, and the projectile including external walls forming an internal cavity to hold an agent and being made to break open when the projectile hits an object to allow the spreading of said agent around the object, means for propelling said projectile from said grip when activated, a firing assembly including trigger means moveable to activate said propelling means thereby causing said projectile to be propelled from said grip, a safety cap interfitting with said grip and including means to prevent movement of said trigger means when fitted on said grip.

11. A combination projectile and grip as defined in claim 10 wherein said safety cap includes walls sized and positioned to fit over the opening in said grip when said safety cap is intermitted with said grip thereby to prevent said projectile from exiting said grip.

* * * * *